US006056925A

United States Patent [19]

Sarstedt

[11] Patent Number: 6,056,925

[45] Date of Patent: May 2, 2000

[54] SAMPLE VESSEL FOR TAKING BLOOD SAMPLES

[75] Inventor: Walter Sarstedt, Nümbrecht, Germany

[73] Assignee: Sarstedt AG & Co., Numbrecht, Germany

[21] Appl. No.: 09/101,942

[22] PCT Filed: Nov. 18, 1997

[86] PCT No.: PCT/DE97/02712

§ 371 Date: Aug. 18, 1998

§ 102(e) Date: Aug. 18, 1998

[87] PCT Pub. No.: WO98/22218

PCT Pub. Date: May 28, 1998

[30] Foreign Application Priority Data

Nov. 19, 1996 [DE] Germany ..... 196 47 673

[51] Int. Cl.[7] ..... B01L 3/14

[52] U.S. Cl. ..... 422/102; 422/72

[58] Field of Search ..... 422/102, 104, 422/72

[56] References Cited

U.S. PATENT DOCUMENTS

| | | | |
|---|---|---|---|
| 3,607,098 | 9/1971 | Strande | 422/102 |
| 3,754,872 | 8/1973 | Zauft | 422/102 |
| 3,807,955 | 4/1974 | Note, Jr. et al. | 422/102 |
| 4,411,163 | 10/1983 | White | 73/864.02 |
| 4,755,356 | 7/1988 | Robbins et al. | 422/102 |
| 4,805,635 | 2/1989 | Korf et al. | 128/763 |
| 4,830,217 | 5/1989 | Dufresne et al. | 220/420 |
| 4,956,298 | 9/1990 | Diekmann | 430/311 |
| 5,038,794 | 8/1991 | Van Valkenburg | 128/763 |
| 5,038,958 | 8/1991 | Dreier | 220/366 |
| 5,236,604 | 8/1993 | Fiehler | 210/782 |
| 5,288,466 | 2/1994 | Burns | 422/102 |
| 5,458,854 | 10/1995 | Burns | 422/102 |
| 5,556,599 | 9/1996 | Amed | 422/102 |

FOREIGN PATENT DOCUMENTS

| | | |
|---|---|---|
| 0 072 006 | 2/1983 | European Pat. Off. . |
| 0 517 119 | 12/1992 | European Pat. Off. . |
| 0 643 944 A1 | 3/1995 | European Pat. Off. . |
| 24 39 218 | 2/1976 | Germany . |
| 2 017 911 | 10/1979 | United Kingdom . |

*Primary Examiner*—Jill Warden
*Attorney, Agent, or Firm*—Herbert Dubno

[57] ABSTRACT

A sample vessel (1) for taking very small amounts of blood, consisting of an outer vessel (2) and an inner vessel (3) which can be inserted into it, which is closed at the bottom, and on top, on the side where the sample is deposited, is configured with an open, very thin-walled blood sample ring (7) which can be closed by a stopper (4) and which protrudes in situ from the outer vessel (2). The outer vessel (2) has a collar (5) which supports the inner vessel (3) below the blood sample ring (7), and which is suitable for holding in centrifuges. The sample vessel makes taking blood samples easier, is simpler to produce and offers a greater variety of possibilities for use.

2 Claims, 2 Drawing Sheets

SAMPLE VESSEL FOR TAKING BLOOD SAMPLES

CROSS REFERENCE TO RELATED APPLICATIONS

This application is a national stage of PCT/DE97/02712 filed Nov. 18 1997 and based upon German national application 196 47 673.9 of Nov. 19 1996 under the International Convention.

FIELD OF THE INVENTION

The invention relates to a sample vessel for collecting very small amounts of blood, e.g. from a patient's fingertip or earlobe, so that collections of venous blood are frequently superfluous.

BACKGROUND OF THE INVENTION

Blood collection devices with a collection tube for the blood have become known from the EP 0 517 119 B1 and from U.S. Pat. No. 5,458,854 A. The tube, or the blood collection vessel has an integrated, vessel-like blood collection space, with an open upper end and a closed and rounded lower end. The upper end of the vessel is made in one piece with a scoop-shaped lip portion, over whose receiving rim the collected blood can run off into the blood collection space, which compared to the tube has a larger diameter. The upper end of the vessel together with its integral scoop-shaped lip portion can be closed by a cap. During blood collection this is attached to the lower vessel end. In order to be able to fit the blood collection vessel into a standard hospital centrifuge, according to the US patent a complementary vessel is coupled to its bottom. Such a device for collecting small blood amounts is also known from EP 0 072 006 B2. In this construction a scoop-shaped lip portion serving for blood collection or a capillary tube is a fixed component of a cap which can be attached to the blood collecting vessel.

The common feature of these blood collection devices consist in that they have to be precisely positioned in order to capture and transfer the blood into the blood collection vessel, namely positioned exactly with the scoop-shaped lip portion on the location of the puncture on the patient. If the positioning is not precise, the blood cannot be transferred in an orderly manner to the vessel, with the consequence that a fraction of the blood can run off outside along the vessel. The small amount collected in the case of capillary blood is thus considerably reduced. In addition the danger of contamination, or injection [presumed typographical error, it should infection increases considerably for the persons collecting the blood and the laboratory personnel.

In order to eliminate the necessity of precise positioning, thereby simplifying the blood collection, it has become known from U.S. Pat. No. 5,038,794 A to provide capillary tube with a bowl-like funnel, whereby the capillary tube with the funnel or the bowl, is screwed into a collection vessel for the extracted quantity of capillary blood.

From DE 24 39 218 A1 it is known to collect the blood in a specially designed capillary vessel, wherein only the mouthpiece is shaped like a capillary tube, while the remaining portion is widened so that it is possible to insert a micropipette. The end opposite to the mouthpiece, i.e. the large opening of the capillary tube, can be closed by a stopper and, if necessary, the capillary tube can then be inserted into a substantially cylindrical surrounding vessel. Instead of centrifuging the blood after it has been removed from the capillary tube, it is possible to use the capillary vessel directly for centrifugation.

Another problem in the preparation and analysis of very small blood amounts consist in finding such vessels which, on the one hand due to their outer dimensions can fit into the conventional laboratory devices, can be labelled (e.g. with bar codes), and at the same time can insure a certain filling level of the sample which is still good for pipetting or can conveniently be handled. Therefore when vessels with the normal wall thickness and with an outer diameter which can be fitted into the commercially available centrifuges are used, then a capillary blood amount with a volume of one to several droplets has such a low filling level that most of the blood is spread all over the inner vessel surface and almost no sample is available for the analysis. If on the other hand vessels with a smaller diameter are used to insure a sufficient filling level, then these do not fit into the commercially available devices. There is a problem with vessels which in the relevant upper area have adequate dimensions to suit the devices and which taper off downwards, namely that these vessels cannot be provided with commercially available bar code labels. In order to meet these contradictory size requirements, there are commercially available vessels whose outer contours correspond to the commercially available laboratory equipment and whose inner vessel diameter is as small as possible. However these big size differences between the outer and the inner diameter are set off by a relatively very big wall thickness. The manufacture of such vessels leads then to the technical problems well known to the injection molding specialists. Besides the quite expensive injection molding tools required for the production of these vessels with a big wall thickness can be used only for the production of vessels from a single type of plastic material. Since different types of plastic materials react differently with respect to blood or any other sample materials, it is necessary to produce vessels from different types of plastic materials according to the requirements specific to the sample material. This means that each time the production requires the use of a different injection molding tool, which results in high investments.

OBJECT OF THE INVENTION

It is the object of the invention to provide a collection vessel for the collection of very small blood amounts, which will eliminate the above-mentioned drawbacks and facilitate the blood collection, and which thereby will be easy to manufacture and offer variable possibilities of use.

SUMMARY OF THE INVENTION

According to the invention this object is achieved in a sample vessel or tube consisting of an outer vessel and an inner vessel insertable in the outer vessel, which is closed at the bottom and on top, on the side where the sample is collected, is designed with an open, very thin-walled blood collection ring which can be closed by a stopper and which in the assembled state protrudes from the outer vessel, whereby the outer vessel has a collar supporting the inner vessel below the blood collection ring and which is suitable for fitting into centrifuges. Due to this two-component design of the sample vessel of the invention with the blood collection ring of the inner vessel which is thin-walled all along its perimeter and the support collar of the separate outer vessel, several advantages can be achieved at the same time. So for instance, differently from the one-component blood vessels, it is possible with far less expense and with considerably fewer complicated injection molding tools, to select any desired shape for the inner vessel, particularly such a configuration with a vessel geometry insuring a good miscibility of the sample and—e.g. in a conical inner vessel—a high level of the serum or plasma after centrifugation, which makes possible a simple and good pipetting of the excess. Besides the free material selection for each of the vessels, it is possible to insert in the outer vessel a variety of inner vessel from the point of view of their volume, e.g. of 200, 300 or 500 microliter.

The wall of the inner-vessel projection protruding from the outer vessel when assembled, i.e. of the blood collection ring simplifies the handling very substantially, because it is no longer necessary to pay attention to the precise positioning of the sample vessel, since over the outer, extremely thin border of the blood collection ring the blood can be captured at any point and it is not required to center the vessel. The blood collection ring is also suited for seating a stopper or cap closing the sample vessel. The outer vessel, since it does not participate directly in the blood collection, can have a size which offers a sufficiently large surface for the application of a measurement or identifying label (bar code). Furthermore the collar of the outer vessel fulfills a double function, it serves for the support of the inner vessel, which can be inserted by press-fitting in a fixed position into the outer vessel, or can be cemented or snapped in, as well as for support during fitting into any centrifuges available on the market.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
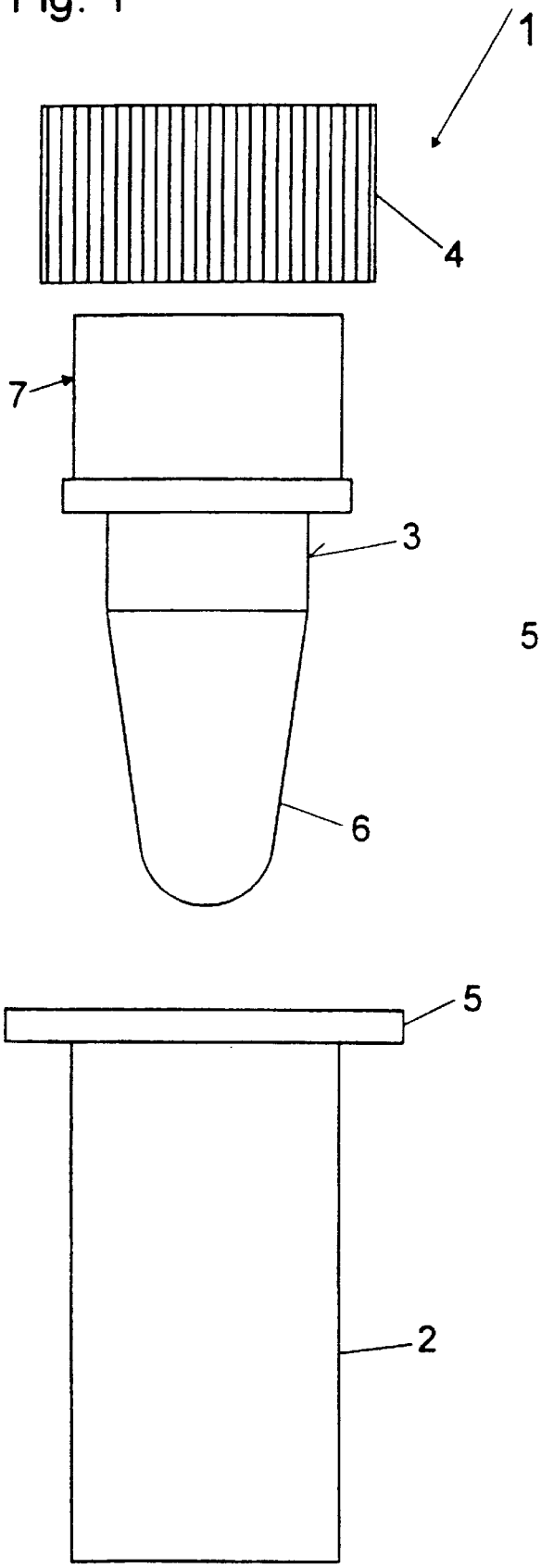
FIG. 1 is an exploded view of the components of a first embodiment of a schematically represented sample vessel.

A sample vessel 1 as shown in FIG. 1 consists of a tubular outer vessel 2, an inner vessel 3 and a stopper or cap 4. The outer vessel 2 is provided with a collar 5, which in the insertion position shown in FIG. 2, supports the inner vessel 3 inserted with a press fit into the outer vessel 2. In the shown construction, the inner vessel 3 closed at the bottom has a conical vessel segment 6, which especially in vessels designed with a small inner volume still insures a high level of serum or plasma after centrifugation, which allows for a good and simple pipetting of the desired amount of liquid.

Figure 2:
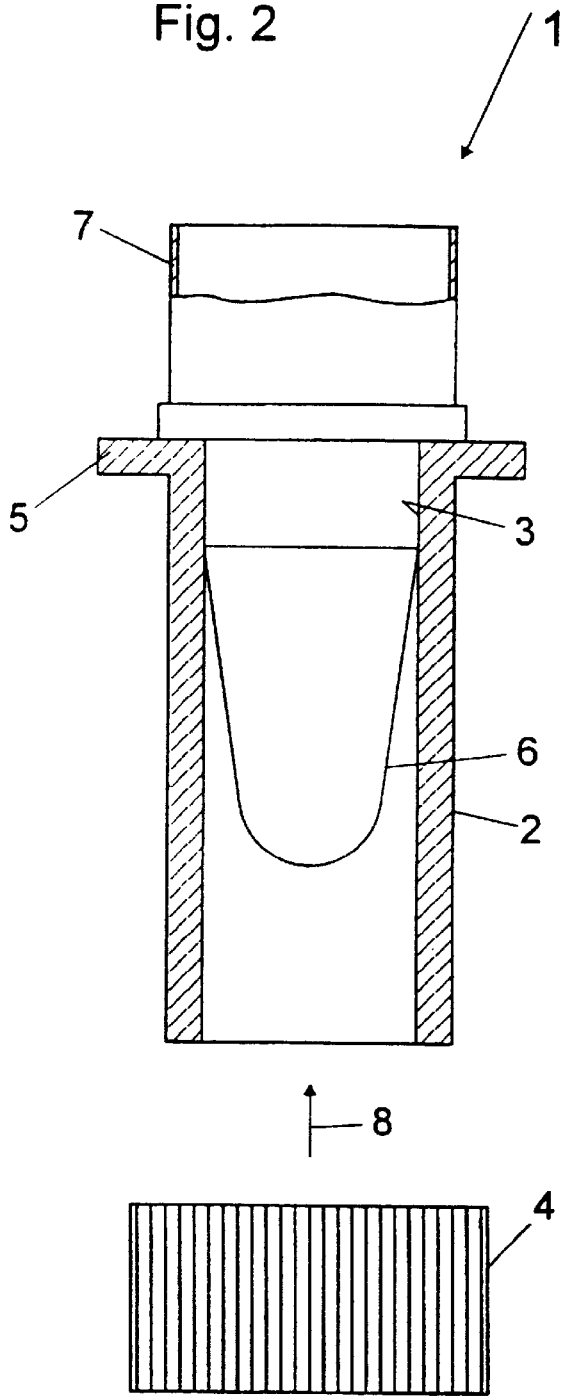
FIG. 2 is a sectional view of the sample vessel according to FIG. 1 ready for blood collection.

The inner vessel 3 is designed with a projection in the form of a very thin-walled blood collection ring 7, which makes possible an all-around collection of the blood captured in the inner vessel 3, so that the sample vessel 1 can be placed against the skin at any point of the blood collection ring 7. Thus a very simple peripheral blood collection is made possible by enabling scooping up of the exiting blood. The stopper 4 which when delivered is attached to the blood collection ring 7 of the inner vessel 3, can be plugged onto the lower end of the outer vessel 2 during blood collection, as indicated in FIG. 2 by arrow 8.

Figure 3:
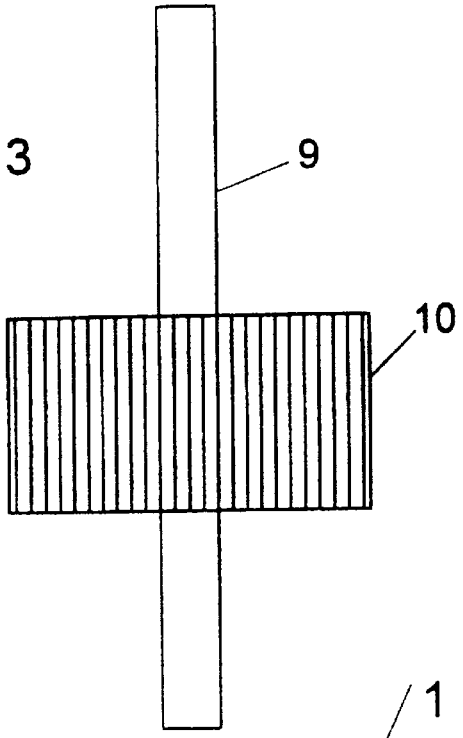
FIG. 3 is an exploded partially sectional view of the sample vessel according to FIG. 2 in a modified embodiment with an attached capillary tube.
Figure 4:
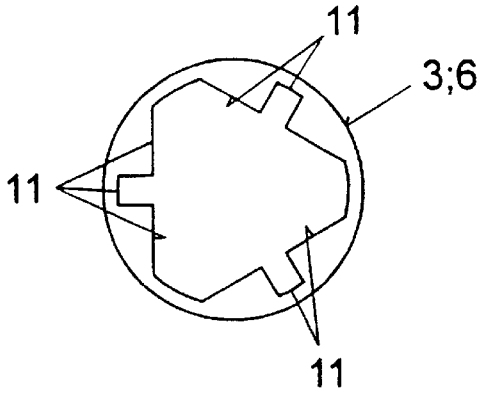
FIG. 4 a section along line IV—IV of FIG. 3.
Figure 4:
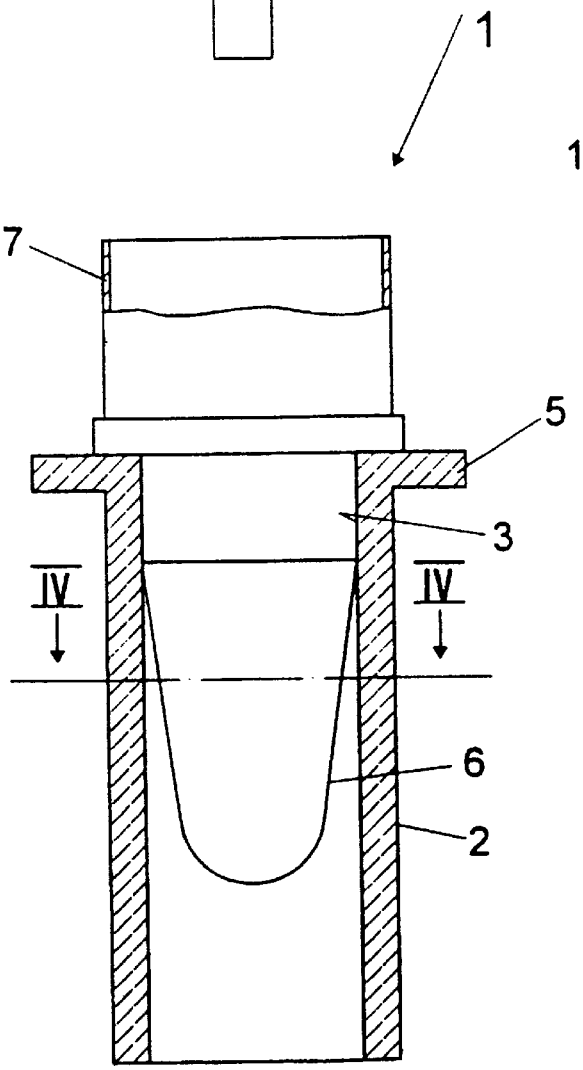

In the modified embodiment shown in FIG. 3, the two-component sample vessel 1 offers also in a simple way the possibility of blood collection through a capillary tube 9. There the latter is arranged in a holding cap 10, which is plugged onto the blood collection ring 7, so that the lower end of the capillary tube opens into the inner vessel 3 and consequently leads the collected blood into the inner vessel 3. A suitable venting in the inner vessel makes sure that the blood reaches the capillary tube 9. When delivered the holding stopper 10 carrying the capillary tube 9 closes the inner vessel 3, while a closing stopper 4 as shown in FIG. 2, and which here is not represented, is plugged onto the lower end of the outer vessel 2. After blood collection, the empty capillary 9 is removed together with the holding stopper 10 from the sample vessel 1, and the blood collection ring 7 of the inner vessel 3 and disposed of, after which the cap 4 is plugged onto the blood collection ring 7 and the sample vessel 1 is thus closed. In order to facilitate the flow of the blood collected either by the blood collection ring 7 or by the capillary tube 9 and guided into the inner vessel 3, the inner vessel 3 can be provided with a flow aid 11, as shown in FIG. 4 which can involve simplified manufacturing, e.g. milling.

I claim:

1. A sampling tube for very small amounts of blood, said sampling tube comprising:

a generally cylindrical outer vessel dimensioned to be receivable in a blood centrifuge and having an open upper end formed with a support collar;

an inner vessel received in said outer vessel and having a closed conical lower end and an open upper end formed by a uniform cylindrical thin-wall blood collection ring projecting above said collar and constituting a scoop for scooping up blood at any point along a periphery of the ring; and a cap fitted onto said ring, said collar supporting said inner vessel on said outer vessel, said outer vessel having an open lower end, said can fitting onto said lower end of said outer vessel, said inner vessel having a circumferential rib below said ring resting against said collar and an intermediate portion of cylindrical outer shape between said conical lower end and said rib, said sampling tube further comprising another cap traversed by a capillary and adapted to be fitted over said ring with said capillary extending into said inner tube.

2. A sampling tube for very small amounts of blood, said sampling tube comprising:

a generally cylindrical outer vessel dimensioned to be receivable in a blood centrifuge and having an open upper end formed with a support collar;

an inner vessel received in said outer vessel and having a closed conical lower end and an open upper end formed by a uniform cylindrical thin-wall blood collection ring projecting above said collar and constituting a scoop for scooping up blood at any point along a periphery of the ring; and a cap fitted onto said ring, said collar supporting said inner vessel on said outer vessel, said outer vessel having an open lower end, said cap fitting onto said lower end of said outer vessel, said inner vessel having a circumferential rib below said ring resting against said collar and an intermediate portion of cylindrical outer shape between said conical lower end and said rib, said inner vessel being provided with a flow aid below said ring and above said conical lower end and having a plurality of flow channels.

* * * * *